US009405234B2

(12) United States Patent
Iida et al.

(10) Patent No.: US 9,405,234 B2
(45) Date of Patent: Aug. 2, 2016

(54) IMAGE FORMING APPARATUS

(71) Applicant: CANON KABUSHIKI KAISHA, Tokyo (JP)

(72) Inventors: Kenichi Iida, Tokyo (JP); Akimichi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/706,861

(22) Filed: May 7, 2015

(65) Prior Publication Data

US 2015/0331366 A1 Nov. 19, 2015

(30) Foreign Application Priority Data

May 13, 2014 (JP) ..... 2014-099839

(51) Int. Cl.
*G03G 15/16* (2006.01)

(52) U.S. Cl.
CPC ..... *G03G 15/1615* (2013.01); *G03G 15/1605* (2013.01); *G03G 15/1685* (2013.01); *G03G 2215/1642* (2013.01)

(58) Field of Classification Search
CPC ..... G03G 15/1615; G03G 15/1605; G03G 15/1685; G03G 15/1642
See application file for complete search history.

(56) References Cited

U.S. PATENT DOCUMENTS

| | | | | |
|---|---|---|---|---|
| 5,649,272 | A | 7/1997 | Kwon | |
| 5,943,526 | A * | 8/1999 | Kodama | G03G 15/167 399/26 |
| 5,966,560 | A * | 10/1999 | Kodama | G03G 15/169 399/318 |
| 2007/0014597 | A1 | 1/2007 | Ishii | |
| 2015/0117915 | A1 * | 4/2015 | Iida | G03G 15/1605 399/313 |

FOREIGN PATENT DOCUMENTS

| | | | |
|---|---|---|---|
| EP | 0487046 | A2 | 5/1992 |
| EP | 2743778 | A2 | 6/2014 |
| JP | 2011-248385 | A | 12/2011 |
| JP | 2014-077938 | A | 5/2014 |

* cited by examiner

*Primary Examiner* — G. M. Hyder
(74) *Attorney, Agent, or Firm* — Canon USA, Inc., IP Division

(57) ABSTRACT

A fiber member and a transfer belt are movable into contact with or away from each other. In an initial contact state in which an image carrying member and the transfer belt are separated and the transfer belt and the fiber member start touching, an upstream side of the fiber member in the movement direction of the transfer belt touches the transfer belt before a downstream side of the fiber member touches the belt. In a contact state in which the image carrying member and the transfer belt are in contact and the transfer belt and the transfer device are in contact, a holding surface is inclined with respect to an opposing portion of an inner peripheral surface of the transfer belt in such a manner that a distance between the holding surface and the opposing portion increases from the downstream side to the upstream side in the movement direction.

18 Claims, 9 Drawing Sheets

IMAGE FORMING APPARATUS

BACKGROUND OF THE INVENTION

1. Field of the Invention

The present invention relates to image forming apparatuses that form images with electrophotography, such as copying machines, printers, fax machines, and multifunction machines.

2. Description of the Related Art

Some image forming apparatuses employing electrophotography such as copying machines or printers include an intermediate transfer belt as a transfer belt. An image forming apparatus including an intermediate transfer belt forms full-color images by performing a first transfer process and a second transfer process.

In the first transfer process, a toner image formed on the surface of the electrophotographic photoconductor is first-transferred to the intermediate transfer belt. The first transfer process is repeatedly performed on toner images of different colors, whereby the toner images of multiple colors are formed on the surface of the intermediate transfer belt. In the second transfer process, the toner images of multiple colors are collectively transferred to the surface of a transfer medium such as a paper sheet. The toner images that have been transferred to the transfer medium are subsequently fixed by a fixing unit, whereby a full-color image is obtained.

Examples usable as a transfer device of an image forming apparatus include transfer devices having, for example, a roller shape, a blade shape, or a brush shape. These transfer devices are contact members that come into contact with the inner peripheral surface of the intermediate transfer belt at a position at which the members are located opposite the corresponding photoconductors. Among the above-described transfer devices, a brush-shaped transfer device includes multiple conductive fiber threads and the individual fibers are independently capable of touching the inner peripheral surface of the intermediate transfer belt. The use of the brush-shaped transfer device thus reduces unevenness in contact-related properties that would result from the use of a roller-shaped or blade-shaped transfer device. Thus, the transfer device can more evenly come into contact with the inner peripheral surface of the intermediate transfer belt. The brush-shaped transfer device thus facilitates reduction of image defects that can occur during the first transfer process such as unevenness in density.

Japanese Patent Laid-Open No. 2011-248385 discloses an image forming apparatus that includes a brush-shaped transfer device as a transfer device. In the brush-shaped transfer device disclosed in Japanese Patent Laid-Open No. 2011-248385, multiple conductive fiber threads constituting a brush are supported by a metal holder made of stainless steel (holding member) using a double-sided adhesive tape. The metal holder is fixed and the conductive fiber threads constituting the transfer device come into contact with the back surface of the intermediate transfer belt using their elasticity.

In the above-described image forming apparatus, however, some of conductive fiber threads of the brush-shaped transfer device may be disposed so as to protrude upstream from a contact area, over which the intermediate transfer belt and the photoconductor drum come into contact with each other, in the direction in which the intermediate transfer belt moves. Conductive fiber threads disposed so as to protrude upstream from the contact area cause an electric field in a gap between the photoconductor drum and the surface of the intermediate transfer belt and the electric field causes discharging (pre-discharging). This discharging may cause a streak-like image defect.

On the other hand, if a conductive fiber thread receives force acting in the direction in which the intermediate transfer belt moves as a result of the conductive fiber rubbing against the intermediate transfer belt, the conductive fiber thread may come out of the holding member or may be displaced over the holding member.

SUMMARY OF THE INVENTION

The present invention provides an image forming apparatus in which multiple conductive fiber threads are brought into contact with a transfer belt, that minimizes the occurrence of streak-like image defects, and that is capable of preventing the conductive fiber threads from coming out of the holding member or being displaced over the holding member.

According to an aspect of the invention, an image forming apparatus includes an image carrying member that carries a toner image; a transfer belt that is endless and movable while being in contact with the image carrying member; and a transfer device that transfers the toner image from the image carrying member to the transfer belt, the transfer device including a fiber member including a plurality of conductive fiber threads and a holding member that holds the fiber member, the fiber member coming into contact with an inner peripheral surface of the transfer belt while being held by a holding surface of the holding member. The transfer device comes into contact with the transfer belt in such a manner that an upstream side of the fiber member in a movement direction of the transfer belt touches the transfer belt before a downstream side of the fiber member in the movement direction touches the transfer belt in an initial contact state in which the image carrying member is separated from the transfer belt and the fiber member starts touching the transfer belt. The holding surface is inclined with respect to an opposing portion of the inner peripheral surface of the transfer belt in such a manner that a distance between the holding surface and the opposing portion of the inner peripheral surface of the transfer belt increases from a downstream side to an upstream side in the movement direction of the transfer belt in a contact state in which the image carrying member and the transfer belt are in contact with each other and the transfer belt and the transfer device are in contact with each other.

Further features of the present invention will become apparent from the following description of exemplary embodiments (with reference to the attached drawings).

DESCRIPTION OF THE EMBODIMENTS

Hereinbelow, embodiments of the present invention are exemplarily described in detail with reference to the drawings. However, the dimensions, materials, shapes, relative positions, or other properties of components described in the following embodiments should be appropriately changed depending on various conditions or the structure of the apparatus to which the present invention is applied. Unless otherwise specifically described, the embodiments are not meant to limit the scope of the invention to those described in the embodiments.

First Embodiment

1. Entire Structure of Image Forming Apparatus

Figure 1:
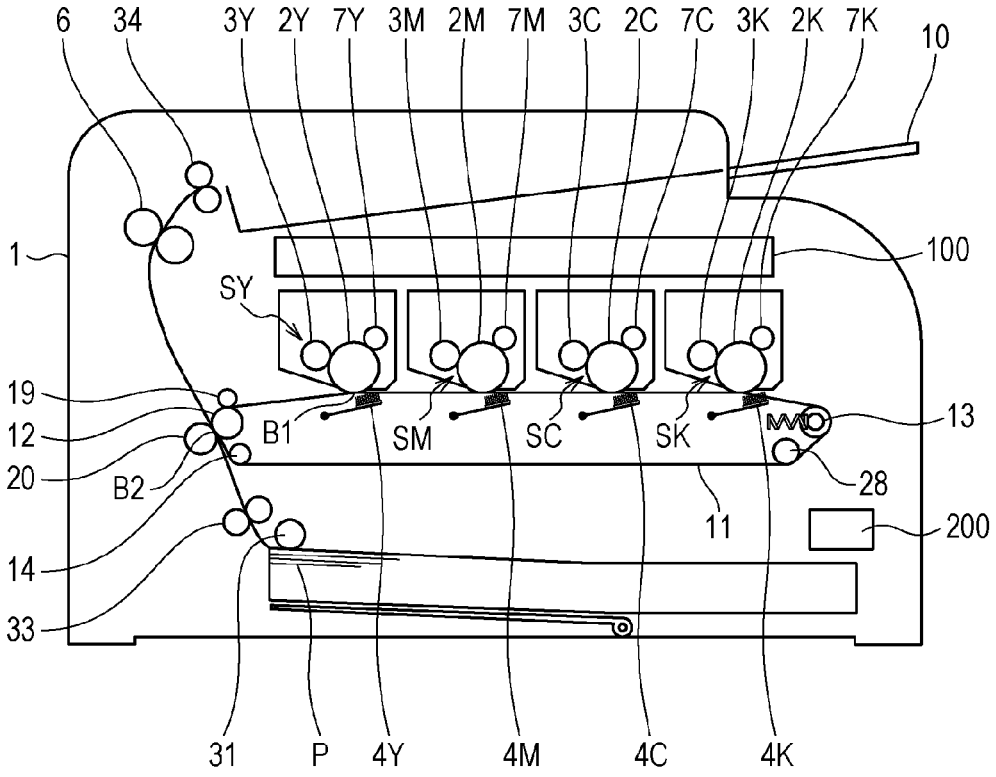
FIG. 1 is a schematic cross-sectional view of an image forming apparatus according to an embodiment of the invention.

FIG. 1 is a schematic cross-sectional view of an image forming apparatus 1 according to a first embodiment of the invention. The image forming apparatus 1 according to the first embodiment is a full-color laser beam printer employing electrophotography. The image forming apparatus 1 is capable of forming images by electrophotography on transfer media such as recording sheets or overhead-projector sheets in accordance with signals transmitted from external devices, such as personal computers, connected with the image forming apparatus 1 in such a manner as to be capable of communicating with the image forming apparatus 1.

The image forming apparatus 1 is an apparatus of a tandem type employing an intermediate transfer method. Specifically, the image forming apparatus 1 obtains recorded images by sequentially first-transferring toner images of different colors, formed in accordance with image information decomposed into multiple color components, onto an intermediate transfer device so that the toner images are stacked one on top of another and then by collectively second-transferring the stacked toner images to a transfer medium.

The image forming apparatus 1 sequentially first-transfers toner images of different colors, formed in accordance with image information decomposed into multiple color components, onto an intermediate transfer belt 11, serving as an intermediate transfer device, so that the toner images are stacked one on top of another. Then, the image forming apparatus 1 collectively second-transfers the stacked toner images to a transfer medium P. Here, the intermediate transfer belt 11 is a transfer belt. The image forming apparatus 1 obtains a recorded image by fixing the toner images onto the transfer medium P. The image forming apparatus 1 includes first, second, third, and fourth stations SY, SM, SC, and SK, which are multiple image forming units. In this embodiment, the first to fourth stations SY to SK respectively form toner images of yellow (Y), magenta (M), cyan (C), and black (K).

In this embodiment, each of the first to fourth stations SY to SK have substantially the same configuration and perform substantially the same operations, except for the colors of toner used in each station. Thus, unless the stations are particularly required to be distinguished from one another, the alphabets Y, M, C, and K at the end of the reference symbols representing the colors for which the components are provided are omitted in the following description and a general description is provided, instead.

Each station S includes a photoconductor drum 2, which is a drum-shaped electrophotographic photoconductor, serving as an image carrying member. The photoconductor drum 2 is driven by a motor, not illustrated and serving as a driving unit, to rotate in a counter-clockwise direction in FIG. 1. Around the photoconductor drum 2, the following units are sequentially disposed in the rotation direction of the photoconductor drum 2: a charging roller 7, serving as a charging unit; a developing unit 3; a brush-shaped transfer device included in a first transfer device, which is hereinafter referred to as a first transfer brush 4; and a drum cleaner, not illustrated and serving as a photoconductor cleaning unit.

In addition, an intermediate transfer belt 11, which is a movable endless belt and serves as a transfer belt, is disposed so as to face the photoconductor drums 2 of the respective stations S. The intermediate transfer belt 11 is made of a tube-shaped endless film and stretched by four rollers, which are stretching members including a driving roller 13, a second transfer opposing roller 12, and stretching rollers 14 and 28. The intermediate transfer belt 11 rotationally moves (rotates) in the direction of arrow d in FIG. 4 and in other drawings as a result of the driving roller 13 being driven to rotate. In this embodiment, the speed at which the surface of the photoconductor drum 2 moves (circumferential speed) and the speed at which the surface of the intermediate transfer belt 11 moves (circumferential speed) are substantially the same.

Multiple first transfer brushes 4, serving as brush-shaped transfer devices, are disposed inward of the inner peripheral surface (back surface) of the intermediate transfer belt 11 at positions at which the first transfer brushes 4 are located opposite the respective photoconductor drums 2 with the intermediate transfer belt 11 interposed therebetween. Specifically, as described below, the first transfer brushes 4 are pressed against the back surface of the intermediate transfer belt 11. As a result, each photoconductor drum 2 and the intermediate transfer belt 11 come into contact with each other and forms a first transfer portion B1, which is a contact area (in FIG. 1, only a first transfer portion B1 in a yellow station is exemplarily illustrated but first transfer portions B1 are similarly formed in other stations). A roller-shaped second transfer roller 20, serving as a second transfer device, is disposed on the outer peripheral surface (top surface) of the intermediate transfer belt 11 at a position at which the second transfer roller 20 is located opposite the second transfer opposing roller 12 with the intermediate transfer belt 11 interposed therebetween. The second transfer roller 20 is pressed against the second transfer opposing roller 12 with the intermediate transfer belt 11 interposed therebetween, whereby the intermediate transfer belt 11 and the second transfer roller 20 come into contact with each other and form a second transfer portion B2. A charging roller 19, serving as an intermediate transfer device cleaning unit, is disposed at a position at which the charging roller 19 is located opposite the second transfer opposing roller 12 with the intermediate transfer belt 11 interposed therebetween.

At the time of image forming, the surface of the photoconductor drum 2 in rotation is uniformly charged by the charging roller 7. At this time, a predetermined charging voltage (charging bias) is applied to the charging roller 7 from a charging power source (not illustrated). A laser scanner 100 irradiates the surface of the charged photoconductor drum 2 with a laser beam L according to the image information. Thus, an electrostatic latent image is formed on the photoconductor drum 2.

The electrostatic latent image formed on the photoconductor drum 2 is developed (rendered visible) into a toner image by the developing unit 3. The developing unit 3 carries toner, serving as a developer, to a rotatable developer carrier, transports the toner to the position at which the toner faces the photoconductor drum 2 (development position), and feeds the toner to the surface of the photoconductor drum 2 in accordance with the electrostatic latent image formed on the photoconductor drum 2. At this time, a predetermined development voltage (development bias) is applied to the developer carrier from a development power source (not illustrated). In this embodiment, the developing unit 3 develops the electrostatic latent image on the photoconductor drum 2 using reversal development. Specifically, the developing unit 3 develops the electrostatic latent image by attaching toner charged in the same polarity as the polarity in which the photoconductor drum 2 is charged (negative polarity in the embodiment) to an image portion (exposure portion) on the photoconductor drum 2 that has been exposed to light after being charged and thus has a low absolute potential.

Each toner image formed on the photoconductor drum 2 in rotation is transferred (first-transferred) to the rotating intermediate transfer belt at the corresponding first transfer portion B1 with the operation of the corresponding first transfer brush 4. At this time, a voltage is applied to the first transfer brush 4 from the first transfer power source, serving as a voltage applying unit. This voltage is a first transfer voltage (first transfer bias), which is a direct current voltage having a polarity (positive polarity in this embodiment) opposite to the polarity in which toner forming the toner image is originally charged (negative polarity in this embodiment). In the first transfer process, toner remaining on the photoconductor drum 2 (remnant first transfer toner) without being transferred to the intermediate transfer belt 11 is removed by a drum cleaner.

To form, for example, a full-color image, the following process including charging, exposure to light, development, and first transfer is sequentially performed from the upstream side in the direction of movement of the surface of the intermediate transfer belt 11 in the first to fourth stations SY to SK. Thus, a multilayer toner image for a full-color image is formed on the intermediate transfer belt 11 as a result of toner images of four different colors, yellow, magenta, cyan, and black being transferred to the intermediate transfer belt 11 so as to be stacked one on top of another.

The toner image on the intermediate transfer belt 11 is transferred (second-transferred) onto a transfer medium P at the second transfer portion B2 by an operation of the second transfer roller 20. Specifically, one of transfer media P accommodated in a cassette is picked up by a feeding roller 31 and then fed to the second transfer portion B2 by a registration roller 33 at a predetermined timing. At substantially the same time, a second transfer voltage (second transfer bias), which is a direct current voltage having a polarity opposite to the polarity in which toner, forming a toner image, is originally charged, is applied to the second transfer roller 20 from a second transfer power source.

Toner remaining on the intermediate transfer belt (remnant second transfer toner) without being transferred to a transfer medium P in the second transfer process is transferred to the photoconductor drum 2 for recovery after being charged by the charging roller 19. The transfer medium P to which the toner image has been second-transferred is transported to a fixing unit 6. The fixing unit 6 heats and presses the transfer medium P while transporting the transfer medium P. The unfixed toner image on the transfer medium P is fixed onto the transfer medium P with heat and pressure. Then, the transfer medium P is transported by a conveying roller 34 to an outer receiving tray 10.

2. Brush-Position Changing Unit

Figure 2A:
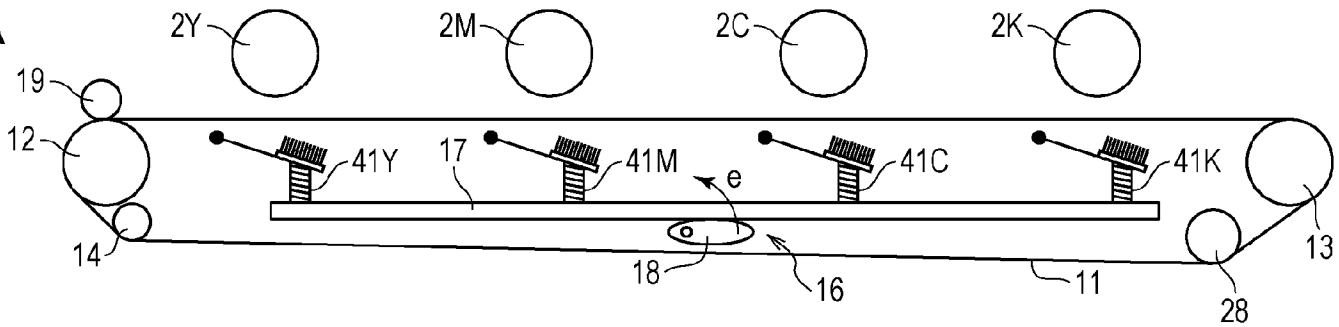
FIGS. 2A to 2C illustrate a first transfer brush according to a first embodiment in the states between a contact state and a separate state.
Figure 2B:
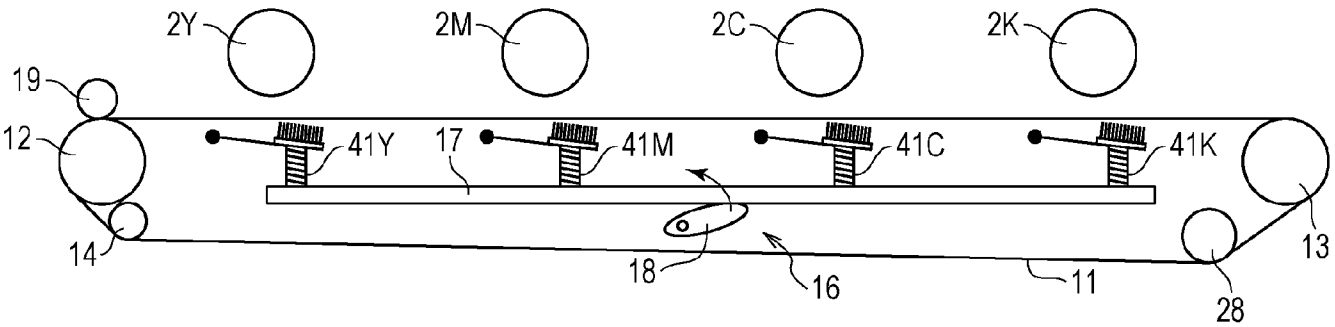
Figure 2C:
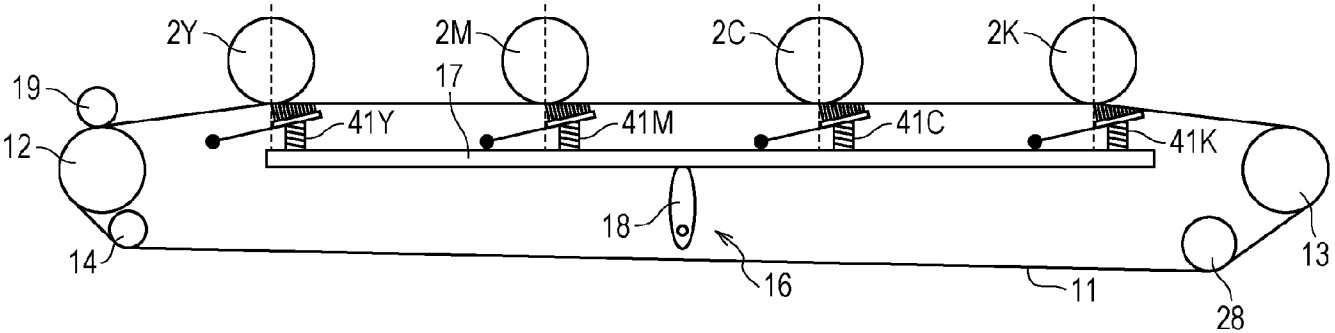

The fiber member 4*a* of each first transfer brush 4 according to the embodiment and the intermediate transfer belt 11 are capable of moving into contact with or away from each other. FIGS. 2A to 2C are schematic diagrams of a brush-position changing unit 16 that moves the first transfer brushes 4 according to the embodiment into contact with or away from the intermediate transfer belt 11. FIG. 2A is a schematic diagram of the first transfer brushes 4 in the separated state in which all the first transfer brushes 4 are separated from the intermediate transfer belt 11 and FIG. 2B is a schematic diagram of the first transfer brushes 4 in the initial contact state in which all the first transfer brushes 4 start touching the intermediate transfer belt 11. FIG. 2C is a schematic diagram of the first transfer brushes 4 in the contact state in which the first transfer brushes 4 have further moved toward the photoconductor drum 2 from the positions illustrated in FIG. 2B. The contact state is a state in which each photoconductor drum 2 is in contact with the intermediate transfer belt 11 and the intermediate transfer belt 11 is in contact with each first transfer brush 4.

In the contact state illustrated in FIG. 2C, the image forming apparatus forms images. In the separated state illustrated in FIG. 2A, a process cartridge including a photoconductor drum 2 can be removed from the apparatus body. As illustrated in FIGS. 2A to 2C, the state of the first transfer brushes 4 can be changed from the separated state to the contact state by the brush-position changing unit 16. The brush-position changing unit 16 includes a plate 17 and a cam 18. The plate 17 is a moving member that moves while supporting the ends of springs 41Y, 41M, 41C, and 41K used for pressing the first transfer brushes 4 against the intermediate transfer belt 11. The cam 18 moves the plate 17.

In the separated state illustrated in FIG. 2A, the brush-position changing unit 16 rotates the cam 18 in the direction of arrow e upon receipt of a command from a controller 200 illustrated in FIG. 1. The cam 18 raises the plate 17 and the first transfer brushes 4 start touching the intermediate transfer belt 11 (in the state illustrated in FIG. 2B). When the cam 18 is further rotated in the direction of arrow e from the state illustrated in FIG. 2B, the plate 17 is further raised, the first transfer brushes 4 raise the intermediate transfer belt 11, and finally, the intermediate transfer belt 11 comes into contact with the photoconductor drums 2. Specifically, as illustrated in FIG. 2C, the contact state is established in which the first transfer brushes 4, the intermediate transfer belt 11, and the photoconductor drums 2 are in contact with one another. The only thing that has to be done to change the state from the contact state to the separated state is to rotate the cam 18 in the direction opposite to the direction of arrow e.

3. First Transfer Brush

Subsequently, the structure of the first transfer brushes 4Y, 4M, 4C, and 4K, serving as first transfer devices according to the embodiment, is described. Since the first transfer brushes 4Y, 4M, 4C, and 4K have the same structure, the symbols Y, M, C, and K are omitted in the following description.

Figure 3:
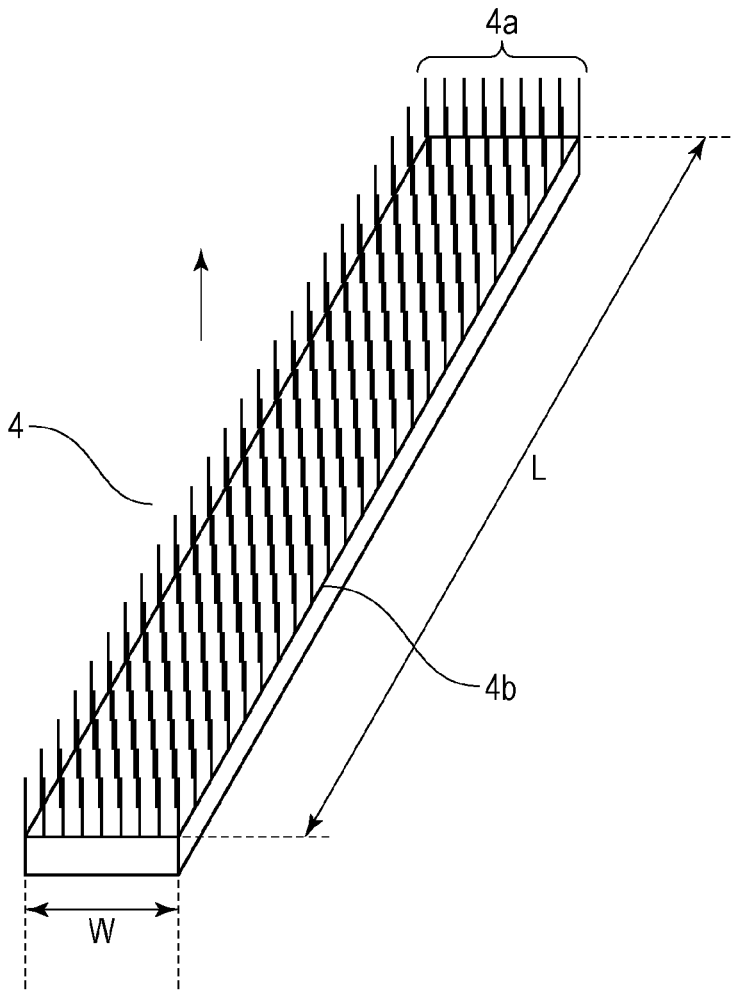
FIG. 3 is a perspective view of the first transfer brush according to the embodiment of the invention.

FIG. 3 is a schematic perspective view of the structure of the first transfer brush 4. The first transfer brush 4 according to the embodiment includes a fiber member 4*a*, including multiple conductive fiber threads, and a flat board 4*b*, supporting the fiber member 4*a*. The multiple conductive fiber threads constituting the fiber member 4*a* are densely arranged.

In this embodiment, the width W of the first transfer brush 4 is 4 mm. The width of the first transfer brush 4 extends in the direction parallel to the direction in which the intermediate transfer belt 11 moves. The length L of the first transfer brush 4 is 230 mm. The length of the first transfer brush 4 extends in the direction perpendicular to the direction in which the intermediate transfer belt 6 moves.

In this embodiment, the width W of the first transfer brush 4 is 4 mm, whereby the contact area over which the first transfer brush 4 and the intermediate transfer belt 6 come into contact with each other can have a sufficiently large width.

Examples usable as the fiber member 4*a* of the first transfer brush 4 include a brush member of a pile textile type or an electrostatic flocking type. Pile textile is textile formed by interweaving pile yarns, serving as conductive fiber threads, into interstices in a ground fabric (corresponding to the board 4*b*) constituted by warp and weft. The pile textile is fixed to a support member by, for example, bonding using a bonding portion (double-sided adhesive tape 43 in the embodiment), so that the first transfer brush 4 serving as a brush member is obtained. Electrostatic flocking, on the other hand, is a method that utilizes electrostatic attracting force in a high-voltage electrostatic field for anchoring short fiber, serving as conductive fiber threads, on an unraised portion (corresponding to the board 4*b*) coated with an electroconductive adhesive in advance substantially perpendicularly to the unraised portion. The fiber member 4*a* can be also obtained with this method.

Examples usable as conductive fiber threads include synthetic fiber impregnated with an electroconductive agent. Specifically, conductive fiber threads made of material such as nylon or polyester containing scattered carbon powder are usable. Usable examples include conductive fiber threads having a single fiber fineness in the range of 2 to 15 dtex, a diameter in the range of 10 to 40 μm, and a dry strength in the range of 1 to 3 cN/dtex. Conductive fiber threads having a resistivity ρfiber in the range of $10^2$ to $10^8$ Ωcm are favorable in terms of the transfer efficiency.

The direction in which the fiber member 4*a* extends from the upper surface of the board 4*b* in the state where the fiber member 4*a* is not brought into contact with the intermediate transfer belt 11 is referred to as a direction of raising (the direction of up-pointing arrow in FIG. 3). The length of each conductive fiber thread from the board 4*b* (fiber length) may be, for example, 1 to 5 mm. The arrangement density of the fiber member 4*a* on the board 4*b* may be, for example, 5000 to 50000 threads/$cm^2$.

In this embodiment, a brush member having the following specifications is used as the first transfer brush 4 having characteristic features:

Specifications of First Transfer Brush:

fiber member, pile textile made of conductive fiber threads;

material of conductive fiber threads, nylon fiber in which carbon powder is dispersed;

single fiber fineness of conductive fiber threads, 7 dtex;

diameter of conductive fiber threads, 28 μm;

dry strength of conductive fiber threads, 1.6 cN/dtex;

resistivity of conductive fiber threads, $10^6$ Ωcm;

fiber length of conductive fiber threads, 2 mm; and arrangement density, 10850 threads/$cm^2$.

4. Restriction on Contact Angle of Fiber Member 4*a* with Respect to Intermediate Transfer Belt 11

Figure 4:
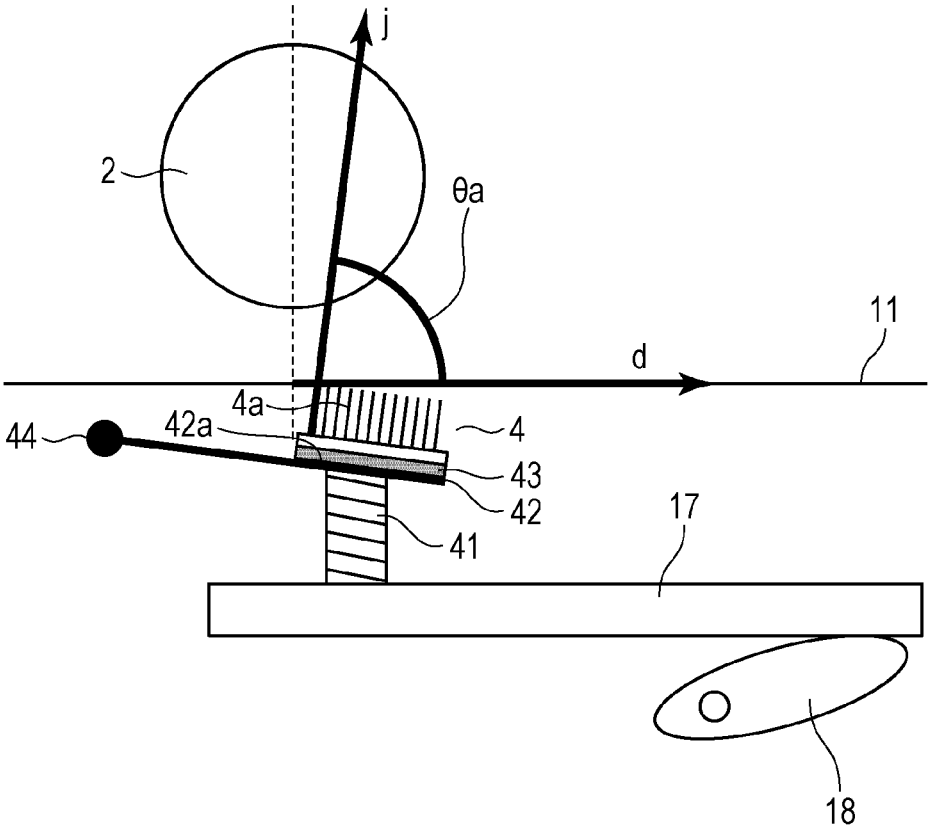
FIG. 4 illustrates the first transfer brush according to the first embodiment in an initial contact state.
Figure 5:
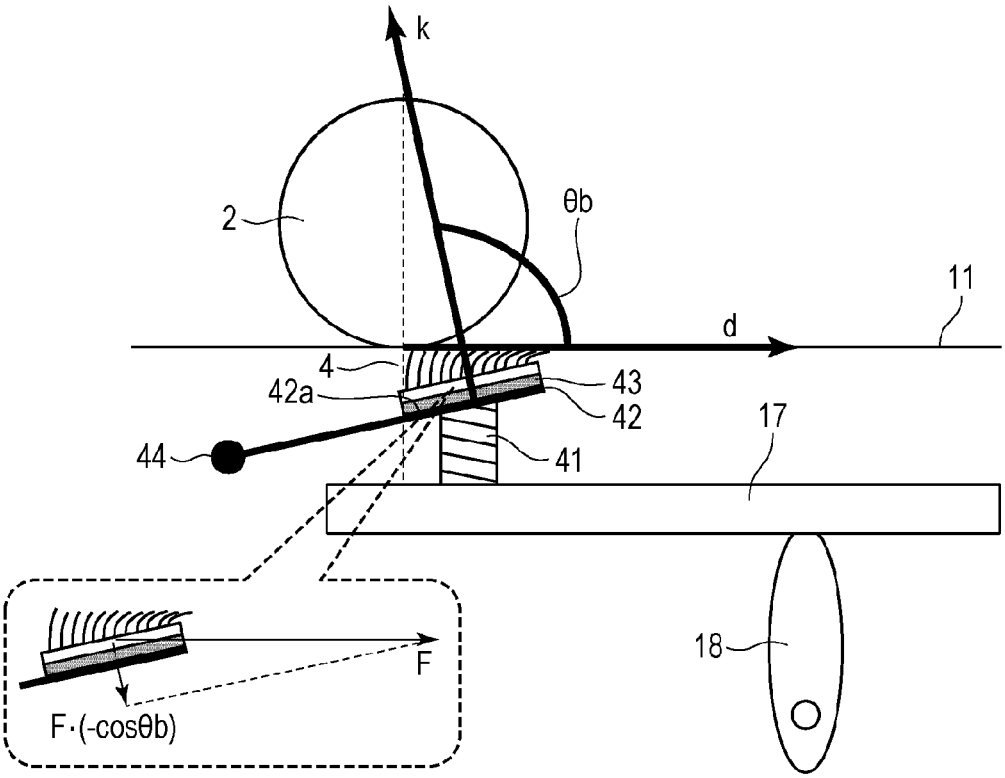
FIG. 5 illustrates the first transfer brush according to the first embodiment in the contact state.

Referring now to FIG. 4 and FIG. 5, the contact angle of the first transfer brush 4 with respect to the intermediate transfer belt 11 is described. FIG. 4 is an enlarged diagram of the first transfer brush 4 and the intermediate transfer belt 11 in the initial contact state illustrated in FIG. 2B. The first transfer brush 4 is held by a holding arm 42, which is a holding member, as a result of the board 4*b* being bonded to the holding arm 42 using a double-sided adhesive tape 43. The holding arm 42 is biased by the spring 41, serving as a biasing member, toward the photoconductor drum 2. In order to hold the first transfer brush 4, the holding arm 42 has a brush-receiving surface (receiving surface) 42*a*, serving as a holding surface, that faces the intermediate transfer belt 11. The receiving surface 42*a* presses the first transfer brush 4 against the intermediate transfer belt 11. The direction in which the intermediate transfer belt 11 moves is the direction of arrow d illustrated in FIG. 4.

The holding arm 42 is rotatable around a rotation shaft 44. The rotation shaft 44 is located upstream from the first transfer brush 4 in the movement direction d of the intermediate transfer belt 11 and inward of the inner peripheral surface of the intermediate transfer belt 11. The direction in which the rotation shaft extends is substantially parallel to the direction in which the rotation axis of the photoconductor drum 2 extends (or substantially perpendicular to the movement direction d of the intermediate transfer belt 11). The rotation shaft 44 and the holding arm 42 that rotates around the rotation shaft 44 restricts the direction in which the first transfer brush 4 is movable and thus restricts the contact angle of the fiber member 4*a* with respect to the intermediate transfer belt 11. Since the rotation shaft 44 is located upstream from the contact area, over which the intermediate transfer belt 11 and the first transfer brush 4 come into contact with each other, in the direction in which the intermediate transfer belt 11 moves and inward of the inner peripheral surface of the intermediate transfer belt 10, the rotation shaft 44 can be rotated in such a direction as to reduce the pressure utilizing a force resulting from the contact between the intermediate transfer belt 11 and the first transfer brush 4. The rotation shaft 44 does not necessarily have to be located at this position and may be located, for example, outward of the outer peripheral surface of the intermediate transfer belt 10 with the use of an L-shaped holding member.

One feature of the embodiment is that, in the initial contact state, the fiber member 4*a* of the first transfer brush 4 comes into contact with the intermediate transfer belt 11 while being inclined toward the downstream side in the movement direction d of the intermediate transfer belt 11. Specifically, the upstream side of the fiber member 4*a* in the movement direction d touches the transfer belt 11 before the downstream side of the fiber member 4*a* touches the transfer belt 11. Specifically, condition A below is satisfied:

Condition A

In the initial contact state, an angle θa (fiber contact angle) formed between the movement direction d of the intermediate transfer belt 11 and the raising direction j satisfies $0<\theta a<90°$; The raising direction j is defined as a direction of raising of conductive fiber threads extending perpendicularly to the holding surface 42*a*, where θa is defined as a fiber contact angle and θa=80° in FIG. 4; As illustrated in FIG. 4, in the initial contact state, the upstream end of the fiber member 4*a* in the movement direction of the intermediate transfer belt 11 comes into contact with the intermediate transfer belt at a position displaced toward the downstream side from the position on the dotted line that passes through the rotation center of the photoconductor drum 2 and that crosses perpendicularly to the intermediate transfer belt 11. At this time, the photoconductor drum 2 and the intermediate transfer belt 11 are separated from each other.

As described above, if the fiber member 4*a* is located so as to protrude upstream from the contact area (first transfer portion B1), over which the photoconductor drum 2 and the intermediate transfer belt 11 come into contact with each other, a transfer electric field is formed in a gap upstream from the contact area between the photoconductor drum 2 and the surface of the intermediate transfer belt 11. The transfer electric field formed upstream from the contact area causes pre-discharging and toner scattering. As a result, portions in which toner scattering occurs and portions in which toner scattering does not occur coexist in the longitudinal direction perpendicular to the movement direction of the intermediate transfer belt 11, causing a streak-like image defect. In the structure in which the brush-position changing unit 16 moves the first transfer brush 4 into contact with the intermediate transfer belt 11 as in the case of the embodiment, the upstream end of the fiber member 4*a* may bend so as to protrude toward the upstream side in the initial contact state.

The structure of the image forming apparatus according to the embodiment satisfies condition A, described above. Thus, in the process from the initial contact state to the contact state, the fiber member 4*a* bends so as to slide over the back surface of the intermediate transfer belt 11 toward the downstream side. Thus, the structure satisfying condition A prevents the upstream end of the fiber member 4*a* from protruding upstream from the contact area, over which the first transfer brush 4 and the photoconductor drum 2 come into contact with each other, in the initial contact state, minimizing the occurrence of streak-like image defects. In this embodiment, the first transfer brush 4 is brought into contact with the intermediate transfer belt 11 in the initial contact state while the intermediate transfer belt 11 is rotationally moved in the direction of arrow d. This structure enables the fiber member 4*a* to bend in the movement direction d of the intermediate transfer belt from the initial contact state upon receipt of force from the intermediate transfer belt 11, and thus can prevent the upstream end of the fiber member 4*a* from protruding.

FIG. 5 is another diagram illustrating the contact angle of the first transfer brush 4 and corresponds to the state (contact state) illustrated in FIG. 2C. Specifically, FIG. 5 illustrates the intermediate transfer belt 11 in the contact state in which the intermediate transfer belt 11 has come into contact with the photoconductor drum 2 from the state (initial contact state) illustrated in FIG. 4 as a result of rotation of the cam 18 (here, the contact state is the state where the photoconductor drum 2 and the intermediate transfer belt 11 are in contact with each other and the intermediate transfer belt 11 and the fiber member 4*a* are in contact with each other). As illustrated in FIG. 5, in the contact state, the distance between the receiving surface 42*a* of the holding arm 42 and the intermediate transfer belt 11 increases toward the upstream side in the movement direction d of the intermediate transfer belt 11. Specifically, condition B below is satisfied:

Condition B

In the contact state, an angle θb (receiving surface contact angle) formed between the movement direction d of the intermediate transfer belt 11 and the normal k normal to the holding arm receiving surface satisfies $90<\theta b<180°$, and $\theta b=110°$ in the image forming apparatus according to the embodiment.

The portion enclosed with the dotted line in FIG. 5 illustrates the force acting on the fiber member 4*a* in an enlarged manner. In the image forming apparatus according to the embodiment, when the first transfer brush 4 receives from the intermediate transfer belt 11 frictional force (F) acting toward the downstream side in the movement direction of the intermediate transfer belt 11, a force ($F\times-\cos\theta b$) acting in the direction in which the first transfer brush 4 is pressed against the holding arm 42 occurs. This is because the movement direction d of the intermediate transfer belt 11 has a vector component in the direction opposite to the normal direction k normal to the holding arm receiving surface 42*a*. Thus, the force of the holding arm 42*a* for holding the first transfer brush 4 increases, and the increased force is effective in preventing the first transfer brush 4 from coming off the holding arm 42 or being displaced over the holding arm 42.

5. Comparative Example

Figure 6A:
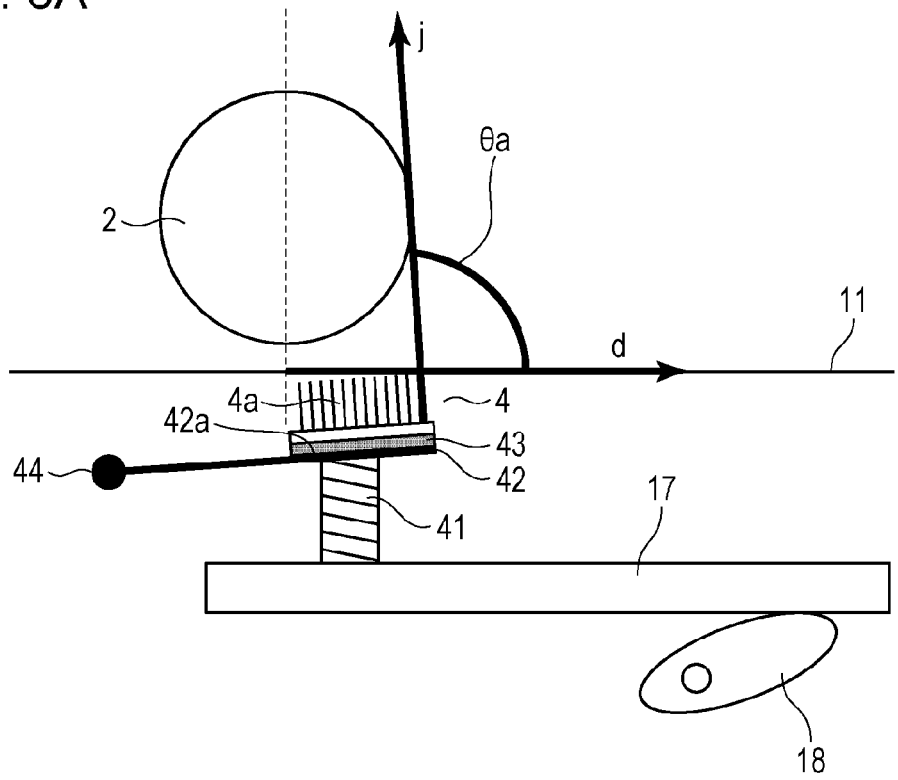
FIG. 6A illustrates a first transfer brush according to comparative example 1 in the initial contact state and FIG. 6B illustrates the first transfer brush in the contact state.

Here, referring to FIGS. 6A to 7B, comparative examples are described. FIGS. 6A and 6B are diagrams of comparative example 1, which has a structure that does not satisfy condition A in the initial contact state but satisfies condition B in the contact state. The structure of comparative example 1 is substantially the same as the structure of the embodiment illustrated in FIG. 4 and FIG. 5 other than the difference particularly specified. In the description of comparative example 1, components having functions or structures the same as or equivalent to those of the components according to the embodiment are denoted by the same reference symbols.

Figure 6B:
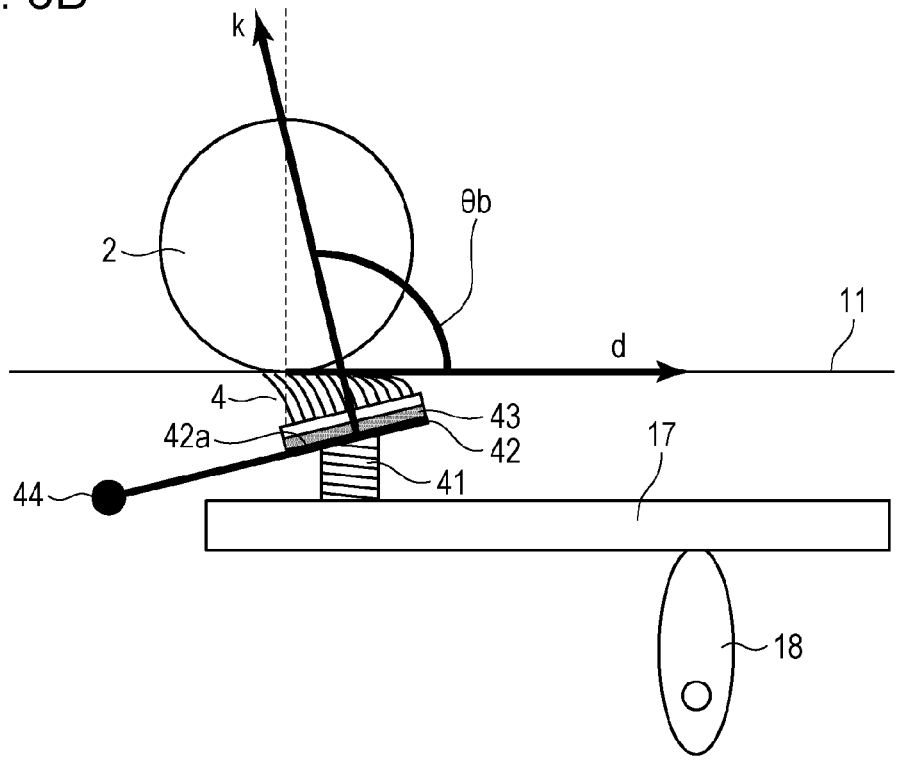

FIG. 6A illustrates a first transfer brush 4 according to comparative example 1 in the initial contact state and corresponds to the state (initial contact state) in FIG. 2B. In comparative example 1, the fiber member 4*a* of the first transfer brush 4 comes into contact with the intermediate transfer belt 11 in the initial contact state while being inclined toward the upstream side in the movement direction d of the intermediate transfer belt 11. Specifically, condition A is not satisfied and the fiber contact angle θa is 100°. FIG. 6B illustrates the first transfer brush 4 according to comparative example 1 in the contact state and corresponds to the state (contact state) in FIG. 2C. Since the structure of comparative example 1 does not satisfy condition A, all the conductive fiber threads of the fiber member 4*a* together bend toward the upstream side in the belt movement direction d in the initial contact state. Thus, some of the conductive fiber threads of the fiber member 4*a* protrude upstream from the photoconductor drum 2 (upstream beyond the dotted line). Since the fiber member 4*a* bends in such a manner that some of the conductive fiber threads protrude toward the upstream side, the protruding threads cause pre-transfer and toner scattering, causing streak-like image defects.

In the contact state, on the other hand, condition B is satisfied as illustrated in FIG. 6B. Thus, the first transfer brush 4 can be prevented from coming off the holding arm 42 or from being displaced over the holding arm 42.

Figure 7A:
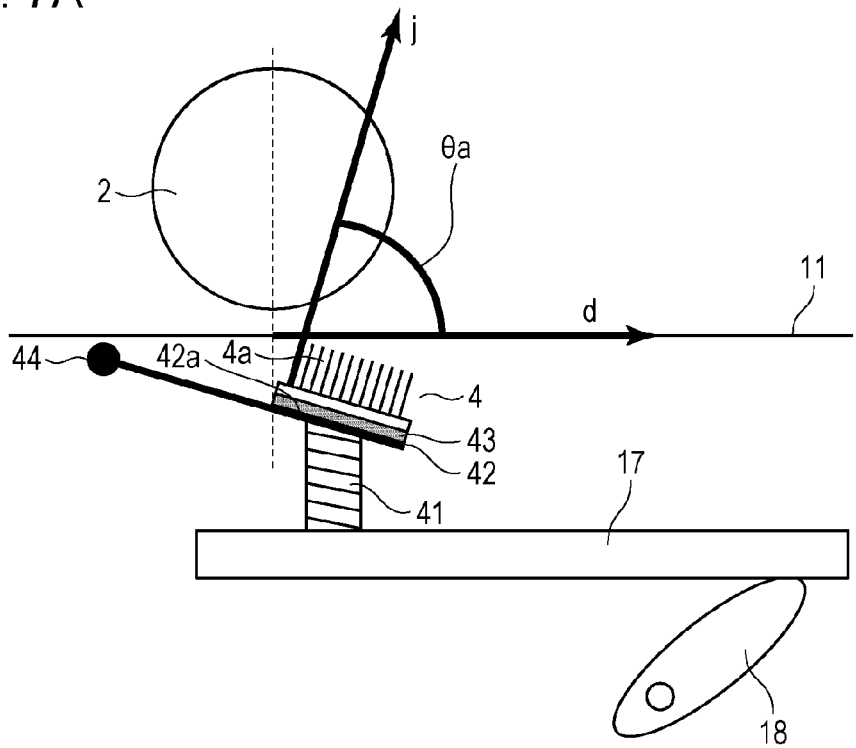
FIG. 7A illustrates a first transfer brush according to comparative example 2 in the initial contact state and FIG. 7B illustrates the first transfer brush in the contact state.
Figure 7B:
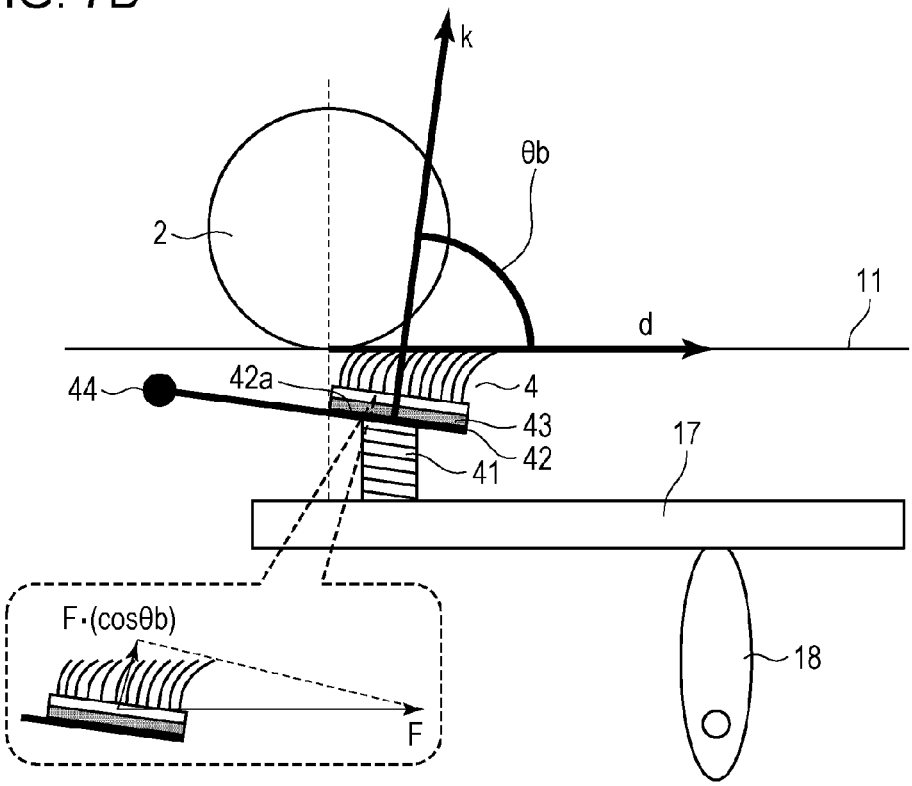

Now, comparative example 2 is described. FIGS. 7A and 7B illustrate comparative example 2, which has a structure that satisfies condition A in the initial contact state but does not satisfy condition B in the contact state. FIG. 7A illustrates the first transfer brush according to comparative example 2 in the initial contact state and corresponds to the state in FIG. 2B. FIG. 7B illustrates the first transfer brush 4 according to comparative example 2 in the contact state and corresponds to the state (contact state) in FIG. 2C.

In comparative example 2, the fiber member 4*a* of the first transfer brush 4 comes into contact with the intermediate transfer belt 11 in the initial contact state while being inclined toward the downstream side in the movement direction d of the intermediate transfer belt 11. Specifically, condition A is satisfied and the fiber contact angle θa is 70°. Thus, as in the case of the embodiment, this structure prevents the occurrence of streak-like image defects. In the contact state, on the other hand, as illustrated in FIG. 7B, the distance between the receiving surface 42*a* of the holding arm 42 and the intermediate transfer belt 11 increases toward the downstream side from the upstream side in the movement direction d of the intermediate transfer belt 11. Specifically, condition B is not satisfied and the receiving surface contact angle θb is 80°. Thus, the force acting in such a direction as to press the first transfer brush 4 against the holding arm 42 would not occur after the intermediate transfer belt 11 starts moving and then the first transfer brush 4 receives frictional force F acting toward the downstream side in the movement direction of the intermediate transfer belt 11 from the intermediate transfer belt 11. The portion enclosed in the dotted line in FIG. 7B illustrates the force acting on the fiber member 4*a* in an enlarged manner. As illustrated in FIG. 7B, in the structure according to comparative example 2, a force (F×cos θb) acting in the direction in which the first transfer brush 4 is separated from the holding surface 42*a* acts on the fiber member 4*a*. This is because the movement direction d of the intermediate transfer belt 11 does not have a vector component in the direction opposite to the normal direction k normal to the holding arm receiving surface 42*a* but instead has a vector component in the direction parallel to the normal direction k normal to the holding arm receiving surface 42*a*. Thus, the force of the holding arm 42*a* for holding the first transfer brush 4 does not increase. Consequently, the first transfer brush 4 may come off the holding arm 42 or may be displaced over the holding arm 42.

As described above, comparative example 1 does not satisfy condition A and thus causes streak-like image defects. Comparative example 2 does not satisfy condition B and thus the fiber member 4*a* of the first transfer brush 4 may come off the holding arm 42 or may be displaced over the holding arm 42.

The embodiment, on the other hand, satisfies condition A and condition B and thus can prevent streak-like image defects from occurring and prevent the fiber member 4*a* of the first transfer brush 4 from coming off or being displaced.

Second Embodiment

In the description of the structure of the first embodiment, the brush-position changing unit 16 moves the first transfer brushes 4 of all the stations into contact with or away from the intermediate transfer belt 11 and the first transfer brushes 4 that are moved into contact with or away from the intermediate transfer belt 11 satisfy condition A and condition B. In the second embodiment, on the other hand, the first transfer brush 4 of at least one station stays in the contact state without being moved into contact with or away from the intermediate transfer belt 11 by the brush-position changing unit 16. Other components of the image forming apparatus according to the second embodiment are the same as those of the image forming apparatus according to the first embodiment and thus are denoted by the same reference symbols.

Figure 8A:
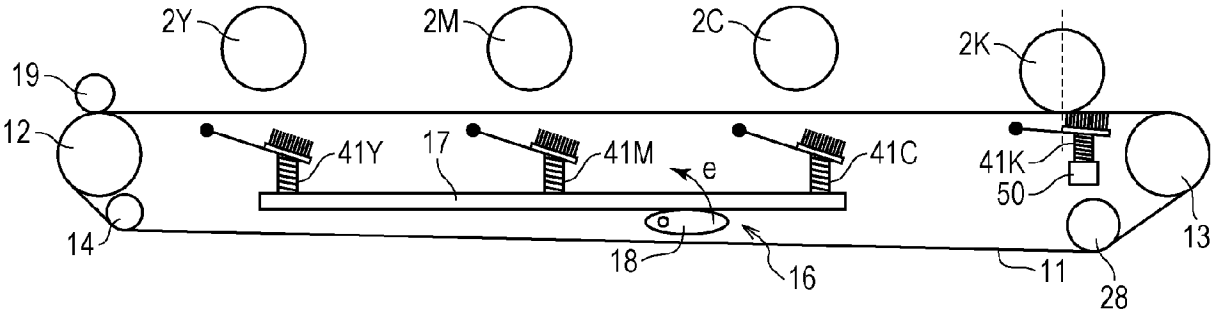
FIGS. 8A to 8C illustrate a first transfer brush according to a second embodiment in the states between a contact state and a separate state.
Figure 8B:
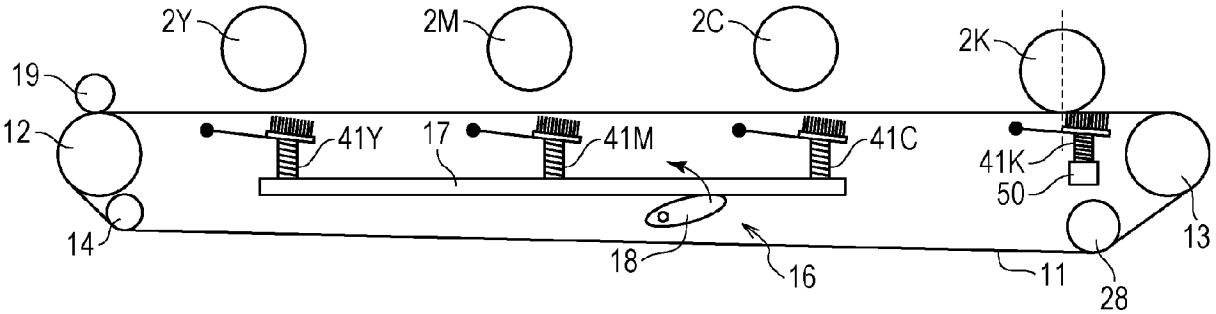
Figure 8C:
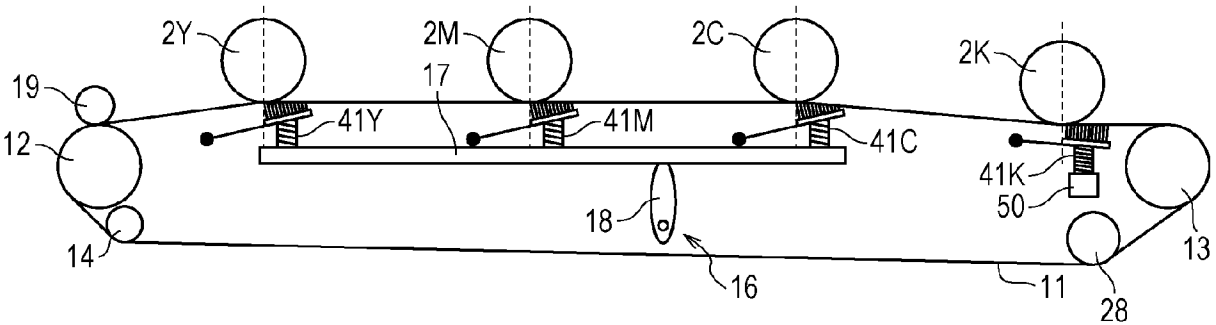

FIGS. 8A to 8C illustrate the operations of moving the first transfer brushes 4 according to the second embodiment into contact with or away from the intermediate transfer belt 11. In the second embodiment, the brush-position changing unit 16 moves the first transfer brushes 4 corresponding to the yellow, magenta, and cyan stations (hereinafter referred to as color stations) into contact with or away from the intermediate transfer belt 11. FIG. 8A is a schematic diagram of the first transfer brushes 4 of the color stations in the separated state in which the first transfer brushes 4 are separated from the intermediate transfer belt 11 and FIG. 8B is a schematic diagram of the first transfer brushes 4 of the color stations in the initial contact state in which the first transfer brushes 4 start touching the intermediate transfer belt 11. FIG. 8C is a schematic diagram of the first transfer brushes 4 of the color stations in the contact state in which the first transfer brushes 4 are further moved toward the photoconductor drums 2 from the positions illustrated in FIG. 8B. The contact state is the state in which the photoconductor drums 2 and the intermediate transfer belt 11 are in contact with one another and the intermediate transfer belt 11 and the first transfer brushes 4 are in contact with one another.

The first transfer brush 4 of each color station has the same structure as that according to the first embodiment: the first transfer brush 4 of each color station satisfies condition A in the initial contact state and satisfies condition B in the contact state. Thus, the use of the first transfer brush 4 that is moved into contact with or away from the intermediate transfer belt 11 enables reduction of the occurrence of streak-like image defects while the fiber member 4*a* of the first transfer brush 4 can be prevented from coming off or being displaced.

On the other hand, the first transfer brush 4 corresponding to the black station stays in contact with the intermediate transfer belt 11 regardless of the states of the brushes 4 corresponding to the color stations, as illustrated in FIGS. 8A to 8C. Such a structure can be employed in an image forming apparatus having a black-and-white-mode image forming function. The black-and-white mode is a mode prepared for preventing deterioration of the photoconductor drums 2 in cartridges other than the cartridge for black in the black-and-white image printing. In the black-and-white mode, an image-forming operation is performed while the photoconductor drums 2 corresponding to colors other than black are separated from the intermediate transfer belt 11.

Figure 9:
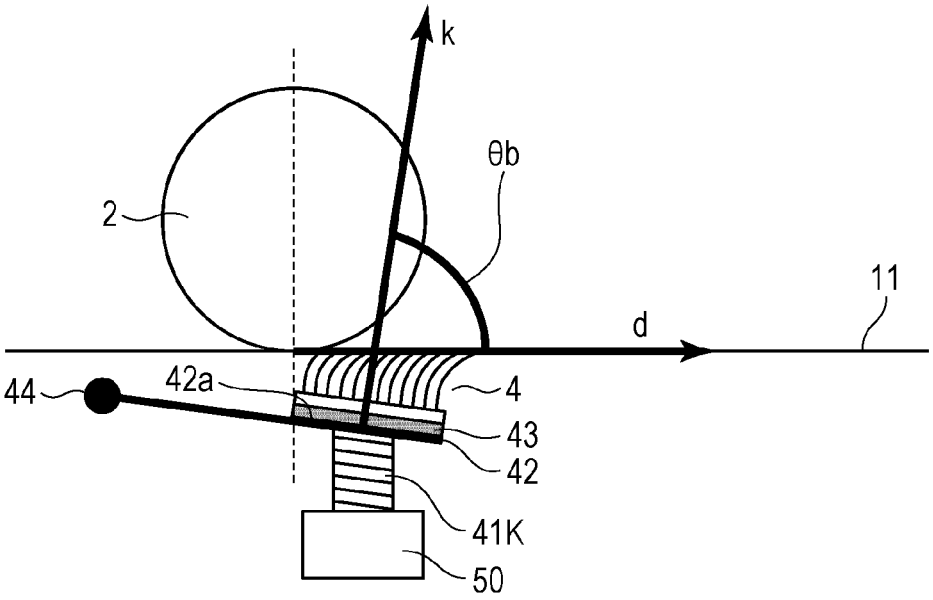
FIG. 9 illustrates the first transfer brush according to the second embodiment in the contact state.

FIG. 9 illustrates the black station according to the second embodiment that stays in the contact state. In the black station, the first transfer brush 4 is supported by a fixed support member 50 with a spring 41K interposed therebetween. The holding arm 42 is rotatable around the rotation shaft 44, which is located upstream from the first transfer brush 4 in the movement direction d of the intermediate transfer belt 11. The rotation shaft 44 and the holding arm 42 (fixed holding member) that rotates around the rotation shaft 44 restrict the direction in which the first transfer brush 4 is movable.

The second embodiment does not satisfy condition B described in the first embodiment in the contact state. As will be described with reference to FIG. 9, the receiving surface contact angle θb is 80°. The spring 41K in the black station according to the second embodiment exerts a pressing force of 2 N, which is lower than the pressing force (4 N) of each of the springs 41Y, 41M, and 41C of the color stations.

The reason why the pressing forces are determined in this manner is as follows. In this embodiment, the brush-position changing unit 16 changes the first transfer brushes 4 of the color stations from the separated state to the contact state with respect to the intermediate transfer belt 11. The springs 41Y, 41M, and 41C exert a pressing force as high as 4 N in order to raise the corresponding first transfer brushes 4 against the tension of the intermediate transfer belt 11 stretched between the driving roller 13 and the second transfer opposing roller 12. In the black station, on the other hand, the first transfer brush 4 does not have to raise the intermediate transfer belt 11 and thus the spring 41K exerts a low pressing force of 2 N.

Thus, although condition B is not satisfied, the first transfer brush 4 receives from the intermediate transfer belt 11 a low frictional force toward the downstream side in the movement direction of the intermediate transfer belt 11 after the start of rotation of the intermediate transfer belt 11 in response to the start of the image forming operation. Thus, the first transfer brush 4 can be prevented from coming off the holding arm or being displaced over the holding arm without the occurrence of a force acting in such a direction as to press the first transfer brush 4 against the holding arm 42.

Figure 10:
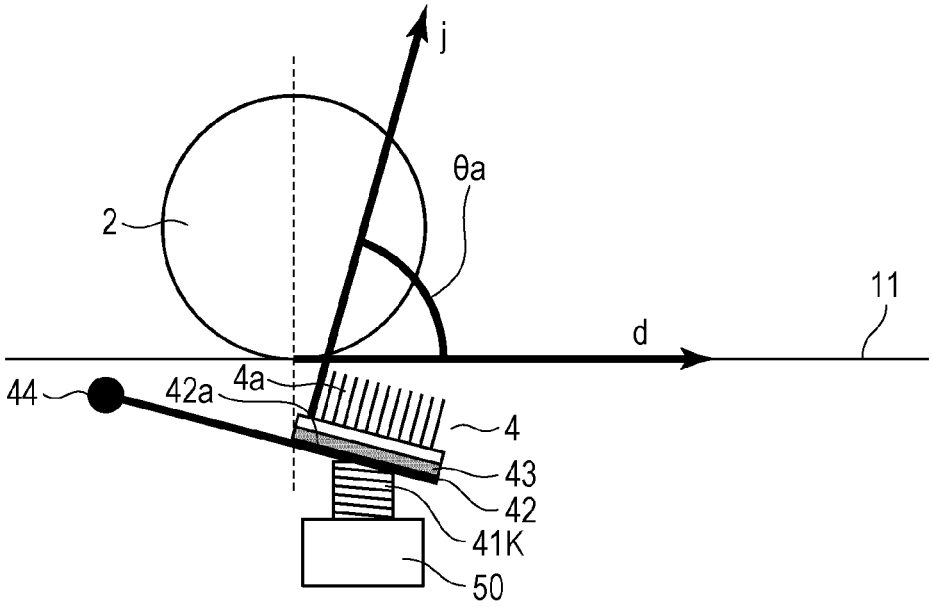
FIG. 10 illustrates the first transfer brush according to the second embodiment in a rotationally withdrawn state.

In the state illustrated in FIG. 9, as the frictional force occurring between the fiber member 4*a* and the intermediate transfer belt 11 increases, the holding arm 42 moves in the direction away from the intermediate transfer belt 11 as illustrated in FIG. 10. The frictional force is an electrostatic cause caused by the surface potential of the photoconductor drum 2 and the first transfer voltage applied to the first transfer brush 4. As described above, the frictional force at the first transfer portion corresponding to black is lower than that at the first transfer portions for yellow, magenta, and cyan. However, the frictional force increases in response to temporary increase of the potential of the photoconductor drum 2 or the first transfer voltage during the image forming operation. In addition, the frictional force also increases with increasing electric resistance of the intermediate transfer belt 11 or the first transfer brush 4 after a continuous image forming operation.

When the frictional force temporarily increases as described above, a force acting in such a direction as to separate the first transfer brush 4 from the intermediate transfer belt 11 around the rotation shaft 44 acts on the holding arm 42 of the first transfer brush 4. Specifically, the state illustrated in FIG. 9 is changed to the state (rotationally withdrawn state) illustrated in FIG. 10. Once the rotationally withdrawn state is established, the contact area between the intermediate transfer belt 11 and the first transfer brush 4 decreases. At this time, an electrostatic cause decreases and thus the frictional force that has temporarily increased decreases. Then, the state returns from the state illustrated in FIG. 10 to the state (contact state) illustrated in FIG. 9. While the intermediate transfer belt 11 is rotating, the state repeatedly changes between the state (contact state) illustrated in FIG. 9 and the state (rotationally withdrawn state) illustrated in FIG. 10. Since the holding arm 42 of the first transfer brush 4 is movable around the rotation shaft, the fiber member 4*a* is prevented from excessively bending toward the downstream side due to a decrease of the frictional force, whereby the intermediate transfer belt 11 and the first transfer brush 4 can keep in a good contact state.

OTHER EMBODIMENTS

In the first embodiment and the second embodiment described above, an image forming apparatus including an intermediate transfer belt as a transfer belt has been described but the present invention is not limited to this image forming apparatus. Specifically, the same effects can be obtained from the use of a conveying belt, as a transfer belt, that transports a transfer medium to which a toner image is directly transferred from the photoconductor drum.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099839, filed May 13, 2014, which is hereby incorporated by reference herein in its entirety.

What is claimed is:

1. An image forming apparatus, comprising:

an image carrying member that carries a toner image;

a transfer belt that is endless and movable while being in contact with the image carrying member; and a transfer device that transfers a toner image from the image carrying member to the transfer belt, the transfer device including a fiber member including a plurality of conductive fiber threads and a holding member that holds the fiber member, the fiber member coming into contact with an inner peripheral surface of the transfer belt while being held by a holding surface of the holding member, wherein the holding member includes a rotation shaft and is rotatable around the rotation shaft, wherein the rotation shaft is located inward of the inner peripheral surface of the transfer belt and upstream from the fiber member in the movement direction of the transfer belt, and wherein the holding surface is inclined with respect to an opposing portion of the inner peripheral surface of the transfer belt in such a manner that a distance between the holding surface and the opposing portion of the inner peripheral surface of the transfer belt increases from a downstream side to an upstream side in the movement direction of the transfer belt in a contact state, in which the image carrying member and the transfer belt are in contact with each other and the transfer belt and the transfer device are in contact with each other.

2. The image forming apparatus according to claim 1, wherein the image carrying member is a photoconductor drum and an upstream end of the fiber member in the initial contact state is located downstream, in the movement direction of the transfer belt, from a position on a line that passes a rotation center of the photoconductor drum and that crosses perpendicularly to the transfer belt.

3. The image forming apparatus according to claim 1, wherein an upstream end of the fiber member in the contact state is located further upstream in the movement direction of the transfer belt than in a case of the upstream end in the initial contact state.

4. The image forming apparatus according to claim 1, further comprising a brush-position changing unit that moves the transfer device into contact with or away from the transfer belt.

5. The image forming apparatus according to claim 4, wherein the transfer belt is in rotation while the brush-position changing unit is moving the holding member.

6. The image forming apparatus according to claim 4, wherein the image carrying member is a first image carrying member that is capable of touching or becoming separated from the transfer belt using the brush-position changing unit, and wherein the image forming apparatus further comprises a second image carrying member that carries a toner image of a color different from a color of a toner image carried by the first image carrying member.

7. The image forming apparatus according to claim 6, wherein the transfer device is a first transfer device that is located opposite the first image carrying member with the transfer belt interposed therebetween, and wherein the image forming apparatus further comprises a second transfer device that is located opposite the second image carrying member with the transfer belt interposed therebetween.

8. The image forming apparatus according to claim 7, wherein the second transfer device includes a second fiber member including a plurality of conductive fiber threads and a fixed holding member that holds the second fiber member and that is not moved by the brush-position changing unit, and wherein the second fiber member comes into contact with the inner peripheral surface of the transfer belt while being held by a holding surface of the fixed holding member.

9. The image forming apparatus according to claim 8, wherein the fixed holding member includes a rotation shaft and the rotation shaft is disposed inward of the inner peripheral surface of the transfer belt and upstream from the second fiber member in the movement direction of the transfer belt.

10. The image forming apparatus according to claim 1, wherein the image carrying member is one of a plurality of image carrying members that carry toner images of respective colors, wherein the transfer device is one of a plurality of transfer devices provided so as to correspond to the plurality of image carrying members, and wherein the image forming apparatus further comprises a brush-position changing unit that moves the plurality of transfer devices into contact with or away from the transfer belt.

11. The image forming apparatus according to claim 1, wherein the transfer belt is an intermediate transfer belt to which a toner image is transferred from the image carrying member.

12. The image forming apparatus according to claim 1, wherein the transfer belt is a conveying belt that transports a transfer medium to which a toner image is transferred from the image carrying member.

13. The image forming apparatus according to claim 1, wherein the transfer device comes into contact with the transfer belt in such a manner that an upstream side of the fiber member in a movement direction of the transfer belt touches the transfer belt before a downstream side of the fiber member in the movement direction touches the transfer belt in an initial contact state, in which the image carrying member is separated from the transfer belt and the fiber member starts touching the transfer belt.

14. An image forming apparatus, comprising:

an image carrying member that carries a toner image;

a transfer belt that is endless and movable while being in contact with the image carrying member; and a transfer device that transfers a toner image from the image carrying member to the transfer belt, the transfer device including a fiber member including a plurality of conductive fiber threads and a holding member that holds the fiber member, the fiber member coming into contact with an inner peripheral surface of the transfer belt while being held by a holding surface of the holding member, wherein the transfer device comes into contact with the transfer belt in such a manner that an upstream side of the fiber member in a movement direction of the transfer belt touches the transfer belt before a downstream side of the fiber member in the movement direction touches the transfer belt in an initial contact state, in which the image carrying member is separated from the transfer belt and the fiber member starts touching the transfer belt.

15. The image forming apparatus according to claim 14, wherein the holding member includes a rotation shaft and is rotatable around the rotation shaft.

16. The image forming apparatus according to claim 15, wherein the rotation shaft is located inward of the inner peripheral surface of the transfer belt and upstream from the fiber member in the movement direction of the transfer belt.

17. The image forming apparatus according to claim 16, further comprising a brush-position changing unit that moves the transfer device into contact with or away from the transfer belt.

18. The image forming apparatus according to claim 17, wherein the transfer belt is in rotation while the brush-position changing unit is moving the holding member.

* * * * *